US009543668B2

(12) United States Patent
Wendt

(10) Patent No.: US 9,543,668 B2
(45) Date of Patent: Jan. 10, 2017

(54) ELECTRICAL TERMINAL AND METHOD

(71) Applicant: PHOENIX CONTACT GMBH & CO. KG, Blomberg (DE)

(72) Inventor: Andreas Wendt, Berlin (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 14/904,435

(22) PCT Filed: Jul. 21, 2014

(86) PCT No.: PCT/EP2014/065603

§ 371 (c)(1),
(2) Date: Jan. 12, 2016

(87) PCT Pub. No.: WO2015/014649

PCT Pub. Date: Feb. 5, 2015

(65) Prior Publication Data

US 2016/0149319 A1 May 26, 2016

(30) Foreign Application Priority Data

Jul. 30, 2013 (DE) ..... 10 2013 108 116

(51) Int. Cl.
*H01R 4/50* (2006.01)
*H01R 4/52* (2006.01)

(52) U.S. Cl.
CPC ..... *H01R 4/5008* (2013.01); *H01R 4/52* (2013.01); *H01R 4/505* (2013.01)

(58) Field of Classification Search
CPC ..... H01R 4/5008; H01R 4/52; H01R 4/505
USPC ..... 439/863, 816–838, 441, 460, 436
See application file for complete search history.

(56) References Cited

U.S. PATENT DOCUMENTS 3,354,518 A * 11/1967 Hoover ..... F16G 11/10 24/134 R
4,589,722 A 5/1986 Hall et al.
4,956,992 A * 9/1990 Undin ..... H01R 43/0428 100/281
5,460,358 A * 10/1995 Sendoykas ..... B25B 5/122 269/32
5,810,628 A 9/1998 Trudel et al.
5,938,488 A * 8/1999 Wilmes ..... H01R 4/40 439/864

(Continued)

FOREIGN PATENT DOCUMENTS

DE 102006043276 A1 10/2007
DE 102011106432 A1 1/2013

(Continued)

*Primary Examiner* — Amy Cohen Johnson
*Assistant Examiner* — Milagros Jeancharles
(74) *Attorney, Agent, or Firm* — Leydig, Voit & Mayer, Ltd.

(57) ABSTRACT

A connection terminal for connecting, in an electrically contacting manner, to at least one conductor includes a current bar held on a mount. The current bar connects to the at least one conductor. The connection terminal also includes an actuation lever, a clamping spring, and a slotted guide. The slotted guide has at least one closure slot and a clamping slot that branches off transversely therefrom. The actuation lever is movably guided in the slotted guide by a first pin and a second pin.

18 Claims, 3 Drawing Sheets

(56) References Cited

U.S. PATENT DOCUMENTS

| | | | | |
|---|---|---|---|---|
| 7,077,711 | B1 * | 7/2006 | Moore | H01R 4/5008 439/773 |
| 8,475,191 | B2 * | 7/2013 | Schafmeister | H01R 4/4836 439/266 |
| 9,219,332 | B2 * | 12/2015 | Wendt | H01R 4/489 |
| 2014/0134892 | A1 | 5/2014 | Wendt | |
| 2015/0357727 | A1 * | 12/2015 | Gassauer | H01R 4/4836 439/751 |
| 2015/0372401 | A1 * | 12/2015 | Stolze | H01R 4/4836 439/816 |

FOREIGN PATENT DOCUMENTS

| | | | |
|---|---|---|---|
| EP | 1909359 | A2 | 4/2008 |
| WO | WO 2013004343 | A1 | 1/2013 |

* cited by examiner

ELECTRICAL TERMINAL AND METHOD

CROSS-REFERENCE TO PRIOR APPLICATIONS

This application is a U.S. National Phase application under 35 U.S.C. §371 of International Application No. PCT/EP2014/065603, filed on Jul. 21, 2014, and claims benefit to German Patent Application No. DE 10 2013 108 116.9, filed on Jul. 30, 2013. The International Application was published in German on Feb. 5, 2015 as WO 2015/014649 A1 under PCT Article 21(2).

FIELD

The present invention relates to an electrical connection terminal and to a method for connecting a conductor to a connection terminal.

BACKGROUND

The prior art describes various connection terminals that are also suitable for connecting conductors of large diameters. In this way, conductors having large cross sections can for example be connected to screw terminals. In the process, the conductor is securely clamped on the electrical connection terminal by means of a screw connection. However, the disadvantage of such screw terminals is that it is not easily possible to simply pivot the stripped conductor in from above. In particular in the case of large, solid conductors, this leads to the assembly being made significantly more difficult since the conductor has to be bent and inserted into the screw terminal axially from the front before the conductor can be clamped.

By comparison, the assembly is simpler in an electrical connection terminal that allows a conductor, which is to be connected, to be pivoted in from above. In this case, the conductor to be connected can be cut to the appropriate length beforehand and is pivoted in during assembly.

A connection terminal of this type is known from WO 2013/004343 A1. In this electrical connection terminal, a manual lever and a clamping lever are provided and interconnected by means of a dynamic transmission ratio such that at the start of the closure operation a relatively small movement of the manual lever is brought about by a large movement of the clamping lever, whilst at the end of the closure operation a large movement of the manual lever leads to a relatively small movement of the clamping lever. In this lever terminal, a good balance between opening angle and actuation force is achieved.

SUMMARY

In an embodiment, the present invention provides a connection terminal for connecting, in an electrically contacting manner, at least one conductor to a current bar held on a mount. The connection terminal includes an actuation lever, a clamping spring, and a slotted guide. The slotted guide has at least one closure slot and a clamping slot that branches off transversely therefrom. The actuation lever is movably guided in the slotted guide by a first pin and a second pin.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
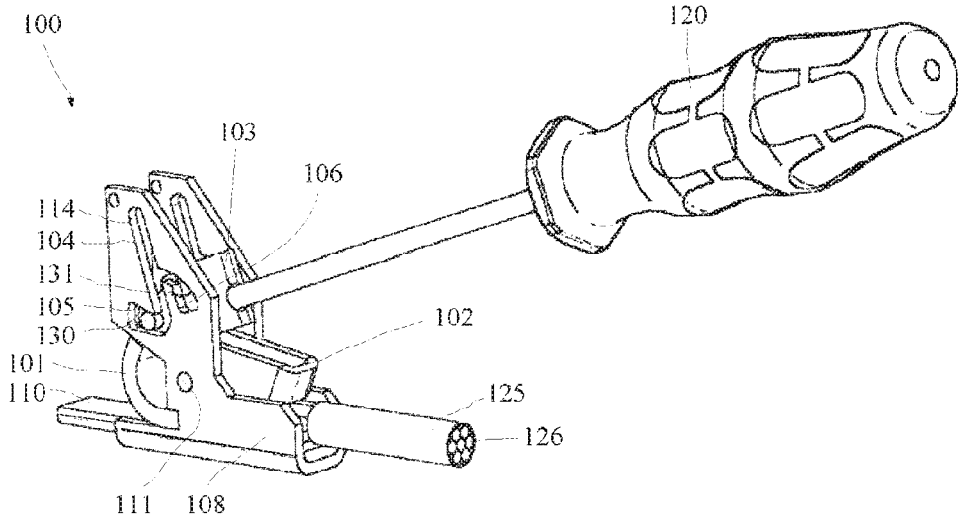
FIG. 1 is a schematic perspective view of an electrical connection terminal according to the invention with a tool in position.

The present invention provides an electrical connection terminal that permits a larger opening range and/or a lower actuation force.

An electrical connection terminal according to the invention is used to connect, in an electrically contacting manner, at least one conductor to a current bar held on a mount. In addition, an actuation lever is provided for opening and closing the connection terminal and a clamping spring is provided for clamping the conductor. According to the invention, a slotted guide is provided which comprises at least one closure slot and a clamping slot that branches off therefrom. In this case, the actuation lever is movably held in the slotted guide or guided therein by a first pin and a second pin.

The electrical connection terminal according to the invention has many advantages since it allows electrical conductors, even of large diameter, to be connected in a simple and flexible manner, and permits reliable contacting. On one hand, guiding the actuation lever in a slotted guide makes it possible for the connection terminal to be closed largely and substantially without force when connecting a conductor, and then for a high clamping force to be applied when the actuation lever is transferred from a closure slot into the clamping slot.

As a result, a simple electrical connection terminal is provided which satisfies all the requirements. The electrical connection terminal according to the invention provides a type of rocker terminal.

In particular, the mount comprises two side walls, which are preferably oriented at least approximately in parallel with one another. The slotted guide is preferably intended to be either identical at least in part or completely identical in both side walls. This means that the actuation lever is guided in both side walls. In this case, the guidance in the closure slot is used for closing, it being possible to negotiate a large path without force or with only a relatively small exertion of force. Lastly, transferring the first pin into the clamping slot leads to the required clamping force being applied.

The connection terminal comprises a free region for pivoting in a conductor. The free pivot region that opens at the top is not encroached upon by the mount or a housing. Preferably, an opening angle between the current bar and the clamping edge is at least 45° in the open state. In particular, the opening angle or the maximum opening angle is greater than 60° and preferably greater than 75°. Opening angles of 90° and even more are possible and preferred. Large opening angles and a pivot region that is freely accessible at the top allows for simple assembly, even of conductors of large cross sections, since the conductors can be pivoted into the connection terminal simply from "above", i.e. from the side opposite the current bar. There is no need to bend or push back the generally rigid conductors to then insert the conductors into the connection terminal from the front.

In preferred developments, the closure slot extends substantially transversely to the current bar. In this case, the angle between the closure slot and the current bar is in particular greater than 30° and preferably greater than 45° and particularly preferably greater than 60° or greater than 75°. The greater the angle between the closure slot and the current bar, the larger the path in the clamping direction that is covered during closing.

Preferably, the slotted guide comprises a release slot which branches off transversely from the closure slot. In this case, the release slot and the clamping slot preferably extend in opposite directions. Such a design makes it possible for the first pin of the actuation lever to enter the clamping slot during closing and for the second pin of the actuation lever to enter the release slot. As a result, a pivot of the actuation lever is used to close the connection terminal, whereby high clamping forces can be generated. The closure slot, the clamping slot and the release slot are slot arms of the slotted guide. The slot arms form guide arms in the mount, within which arms the first pin and the second pin of the actuation lever can be moved in a guided manner.

In preferred embodiments, the release slot, the clamping slot and at least the part of the closure slot that interconnects the release slot and the clamping slot are generally "5"-shaped. If the first pin of the actuation lever enters the clamping slot and the second pin of the actuation lever enters the release slot, a rotation of the actuation lever about a virtual central axis of the actuation lever is achieved overall. This allows for a compact design.

In preferred embodiments, the first pin has a larger diameter than the second pin. Preferably, the first pin has a larger diameter than a width of the release slot. Particularly preferably, the second pin has a smaller pin than said width of the release slot. Such a development ensures that the first pin cannot be inserted into the release slot. However, the second pin can be pivoted into the release slot. In this case, it is preferable for the width of the release slot to be smaller at the branching point from the closure slot than the diameter of the first pin, and so the first pin is prevented from entering the release slot. However, it is also possible for the minimum width of the release slot to be at a small distance from the branching point. In this case, at least insertion far into the release slot is prevented. The rest of the release slot can have a larger width again.

In particularly preferred embodiments, in the clamped state, the first pin is in the clamping slot and the second pin is in the release slot. It is also preferable for the first pin and the second pin to be in the closure slot when in the open state. As a result, linear guidance is made possible first when moving from the open state to the clamped state, and so on one hand a greater opening angle of the connection terminal is made possible while on the other hand the necessary actuation path is relatively small.

In all embodiments, it is preferable for a clamping lever to be provided in addition to the actuation lever. In this case, the actuation lever acts on the clamping lever during closing. In the process, the clamping lever is pivotally held in the mount in particular by means of a pivot pin. The clamping lever can have at least one clamping edge for thus clamping an inserted conductor against the current bar.

Since a clamping lever is also used in addition to the actuation lever, a particularly effective transmission ratio can be provided. During closing, the actuation lever is first guided in the closure slot by the two pins, as a result of which the clamping lever is pivoted through a large pivot angle. Next, when the first pin of the actuation lever is transferred into the clamping slot, the actuation lever is pivoted while the actuation lever acts on the clamping lever. By means of an eccentric on the actuation lever, a high force ratio is provided, and so high clamping forces can be applied even at relatively low actuation forces. In the process, the actuation lever acts on the clamping lever via the eccentric.

More preferably, the clamping spring acts on the first pin and the pivot pin when in the clamped state. In the clamped state, the clamping spring is preferably biased and applies the necessary force to the clamping lever continuously and reliably. In the process, it is particularly preferable for the clamping lever to be behind a dead centre when in the clamped state. This means that in the clamped state there is self-locking, in which any pivot of the clamping lever first requires a force to be applied. This means that when trying to both close and reopen the clamping lever, a higher amount of force has to first be exerted by the clamping spring having to first be opened further, for example counter to the clamping force thereof.

In particularly preferred embodiments, the first pin rests against the clamping spring when in the clamped state. Particularly preferably, the first pin is arranged at a distance from the clamping spring when in the open state. This is preferably accomplished by the clamping spring having a generally C-shaped design. When closing the connection terminal, the first pin and the second pin of the actuation lever are first guided in the closure slot, and so the actuation lever moves towards the current bar together with the first and second pin. During this movement, the first pin enters between the two ends of the clamping spring. The actuation lever is then pivoted, and so the first pin enters the clamping slot and the second pin enters the release slot. Upon further pivoting, the first pin is pressed against an arm of the clamping spring, and therefore the clamping spring is biased and applies the necessary clamping force when the actuation lever is pivoted further.

When opening the electrical connection terminal, the sequence happens in reverse, so the first pin relieves the load on the leg of the clamping spring and eventually moves away therefrom. Upon further movement into the open state, the first pin is lastly moved out of the cross section of the clamping spring. However, it is also possible for the first pin to constantly remain within the clamping spring cross section spanned by the two legs, and to not rest against the clamping spring when in the open state, whereas, when in the clamped state, said pin directly or indirectly rests against a leg of the clamping spring in order to preload the clamping spring.

In preferred developments, the actuation lever comprises at least one tool opening. For example, the tool opening can be suitable for receiving a screwdriver or a similar rod-shaped tool, and so the actuation lever can be actuated by means of a tool inserted into the tool opening.

Bent lugs can be provided on the actuation lever. It is also possible for at least one pin, which acts as a counterbearing during actuation, to be held on the actuation lever. For example, the actuation lever can comprise bent lugs and/or at least one peg as a counterbearing so that force is transmitted to the actuation lever effectively from a tool received at the tool opening.

In preferred developments, at least one return spring is provided, which preloads the actuation lever into the open position or open state. In preferred embodiments, the return spring is arranged such that the return spring increases the clamping force when in the clamped state. This is advantageous since the return spring does not reduce the clamping action when in the clamped state.

In all embodiments, it is particularly preferable for the mount, the clamping lever and the actuation lever to each be punched bent parts. This allows simple and cost-effective production. Simple assembly is also made possible. At the same time, rigid components are provided, which also allow a plurality of opening and closing operations to take place without hindrance.

In particularly preferred developments, at least one groove for securing an inserted conductor is provided on the current bar. Furthermore, preferably at least one conductor guide is provided for centring a conductor held on the current bar. It is possible and preferable for the groove to be positioned on the current bar at the point where the clamping edge presses against an inserted conductor. In particular with relatively thin conductors, this causes the conductor to bend locally into the groove, and so the extraction force required is significantly increased. The conductor guide for centring means that a conductor is received centrally and in a reproducible manner, and so reproducible conditions and non-uniform loads can be prevented. For example, two conductor guides can be provided in a V-shaped structure at an angle of 120° in order to centre inserted conductors.

The method according to the invention is used to clamp at least one conductor on a connection terminal in order to contact the conductor in an electrically conductive manner. In this case, a current bar is held on a mount of the connection terminal. An actuation lever is provided for actuation. At least one clamping spring is used to generate a clamping force. The actuation lever is movably guided in a slotted guide by a first pin and a second pin. For connection, the actuation lever is first guided in the closure slot of the slotted guide by the first pin and the second pin. When the first pin reaches a clamping slot that branches off transversely from the closure slot, it is guided into the clamping slot in order to clamp the conductor.

The method according to the invention has the significant advantage that the connection terminal is substantially closed when the first pin and second pin are guided within the closure slot, while the necessary clamping force is applied when the first pin is guided in the clamping slot. As a result, a particularly high transmission ratio is provided in a very simple manner. At the start of the closing operation, a relatively small path, which leads to a significant closure movement, is covered by the tool, and then a larger path is covered by the tool using a small amount of force while the necessary high clamping force is generated on the connection terminal.

Preferably, the actuation lever is first guided in a longitudinal direction and then pivoted. Particularly preferably, during pivoting the second pin enters a release slot that branches off transversely from the closure slot.

Overall, the electrical connection terminal allows for a particularly large opening range and a low actuation force since the electrical connection terminal is initially largely closed when the actuation lever, which acts as an eccentric or comprises an eccentric, moves downwards. Next, during actuation use is made of the whole pivot angle for clamping. By contrast, in the prior art at least a portion of a pivot angle was already used for clamping.

Since a large pivot angle can be used during actuation for clamping, it is possible to use a particularly strong spring that is suitable for applying high clamping forces.

Overall, a connection terminal is provided in which even thick and hard to bend or unslidable connection lines can be pivoted into such a connection terminal. As a result, the electrical connection terminal can also be used for connecting connection lines that otherwise cannot reach the clamping body.

FIG. 1 is a schematic perspective view of an electrical connection terminal 100 having a cable 125 inserted which has a plurality of conductors 126. In this figure, a tool 120 in the form of a screwdriver is inserted in the actuation lever 103 of the electrical connection terminal 100 for transferring the electrical connection terminal 100 into a clamped state 145.

In the clamped state 145 (FIG. 10), the clamping lever 102 clamps the inserted conductors 106 against the current bar 110. The current bar 110 is held on the mount 108, which can be enclosed by a plastics housing (not shown here). The connection terminal 100 can be designed as a series terminal.

The clamping lever 102 is pivotally held on the mount 108 by means of a pin 111. A leg 136 of the clamping spring 101 rests against the pin 111 (cf. also FIG. 7).

The actuation lever 103 comprises (cf. FIG. 2) a tool opening 109. A first pin 130 and a second pin 131 are provided on the actuation lever. In the housing, a slotted guide 114 is provided, which comprises a closure slot 104 that is oriented linearly in this case and extends transversely to the current bar 110. A clamping slot 105 into which the first pin 130 is inserted branches off from the closure slot 104 at the lower end thereof. The second pin 131 is inserted into the release slot 106, which also branches off from the closure slot 114.

The first pin 130 rests against the leg 137 of the clamping spring 101 (cf. FIG. 7), and so, when the tool 120 pivots further, the clamping spring 101 is clamped when the first pin 130 moves further in the clamping slot 105.

Figure 2:
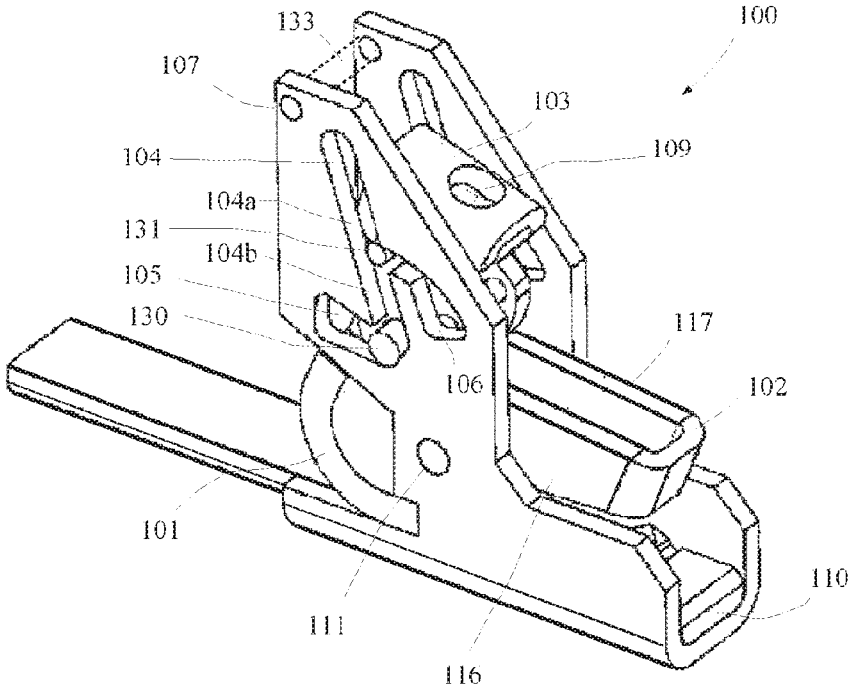
FIG. 2 is an enlarged view of the electrical connection terminal according to FIG. 1.

FIG. 2 is a schematic enlarged view of the electrical connection terminal 100 from FIG. 1.

The closure slot 104 comprises a first part **104*a* and a second part 104*b*. The first part 104*a* extends upwards from the branch of the release slot 106 and the second part 104*b* extends downwards from the branch of the release slot 106. The clamping slot 105 into which the first pin 130 is inserted during clamping branches off at the lower end of the closure slot 104. By contrast, the second pin 131 enters the release slot 106** during clamping.

At the upper end of the mount 108, a hole 107 is provided for a pin 133 (shown by a dashed line) on which a return spring 135 (not shown here) acts in order to preload the actuation lever 103 into the open position. As with the mount 108, the clamping lever 102 is designed as a punched bent part. The clamping lever 102 comprises two spaced-apart and in this case parallel side walls 116 and 117. The clamping lever 102 is pivoted about the pin 111 that is held on the mount 108.

Figure 3:
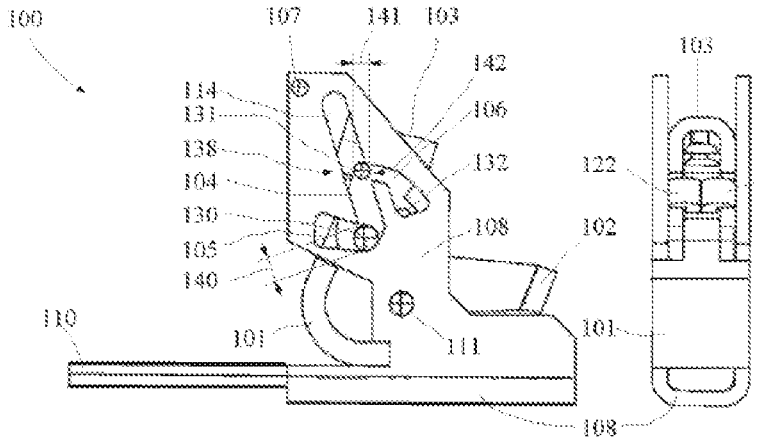
FIG. 3 is a side view of the electrical connection terminal according to FIG. 1.

FIG. 3 is a side view of the electrical connection terminal 100. It can be seen in this drawing that the external diameter 140 of the first pin 130 is larger than the external diameter 141 of the second pin 131. More particularly, the external diameter 140 of the first pin 130 is larger than the width 142 of the release slot 106 at the branching point 138 from the closure slot 104. This prevents the first pin 130 from accidentally entering the release slot 106.

During the movement from an upper open position into a clamped state, the actuation lever 103 is moved downwards by the first pin 130 and the second pin 131. When in this case the first pin 130 reaches the bottom of the closure slot 104, the second pin 131 reaches the branch of the release slot 106. Next, the first pin 130 can enter the clamping slot 105 while the second pin 131 is guided into the release slot 106 when the actuation lever 103 is pivoted.

The actuation lever 103 comprises a tool opening 109, into which a tool 120 can be inserted.

Figure 4:
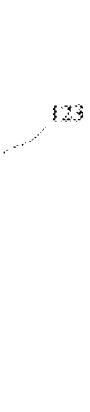
FIG. 4 is a front view of the electrical connection terminal according to FIG. 1.

As can be seen from the front view according to FIG. 4, integrally formed bent lugs 122 and 123 are provided on the actuation lever 103, which lugs form a counterbearing for an inserted tool.

In the front view of the electrical connection terminal 100, it can be seen that the clamping spring 101 extends outside the mount 108 over the entire width of the mount 108. This achieves particularly high strength.

Figure 5:
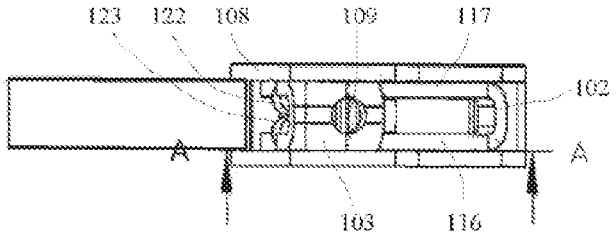
FIG. 5 is a plan view of the electrical connection terminal according to FIG. 4.

In the plan view according to FIG. 5, the tool opening 109 in the actuation lever 103 can be seen from above. Also visible are the bent lugs 122 and 123 acting as counterbearings for a tool.

Figure 6:
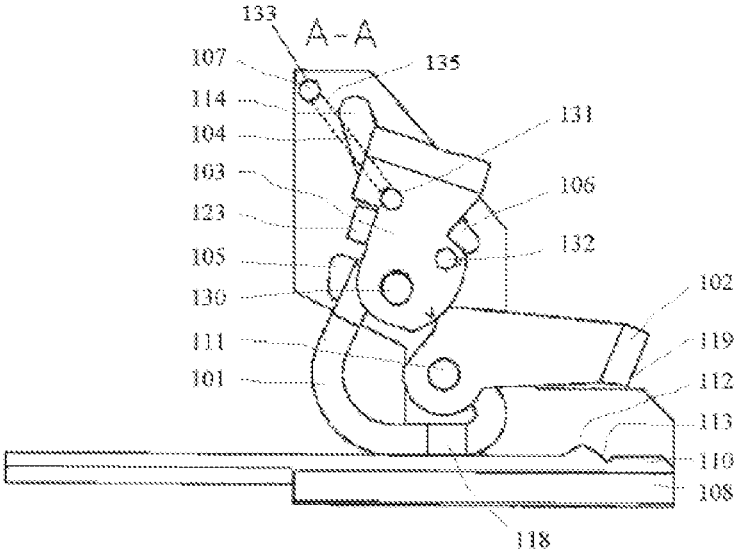
FIG. 6 is a cross section according to the sectional line A-A from FIG. 5.

FIG. 6 shows the section A-A from FIG. 5. In this view, the front wall of the mount 108 is cut away. The clamping spring 101 comprises a narrowing 118. The clamping spring 101 engages, by its leg 136, behind the pin 111 of the clamping lever 102. In this state, the other leg 137 of the clamping spring 101 rests against the first pin 130 of the actuation lever 103. In this drawing, the dashed lines show the return spring 135 between the pin 133 and the second pin 131, which spring serves to automatically transfer the actuation lever 103 into the open position after the actuation lever 103 pivots back. By means of an appropriate spring, the clamping lever 102 is also preloaded into the open position.

In this drawing, a groove 113 and a guide 112 can be seen on the current bar 110, below the clamping edge 119 of the clamping lever 102. The groove 113 causes conductors of in particular relatively low diameters to be received in a particularly extraction-proof manner since they are pressed into the groove by the clamping edge 119. The guide 112 causes conductors being held to be centred on the current bar 110.

In the following, the operation of the electrical connection terminal 100 will be explained with reference to FIGS. 7 to 10. In this context, FIGS. 7 to 10 are each highly schematic views of various positions and settings of the electrical connection terminal 100. In these drawings, the mount 108 and other parts have been omitted for reasons of clarity.

Figure 7:
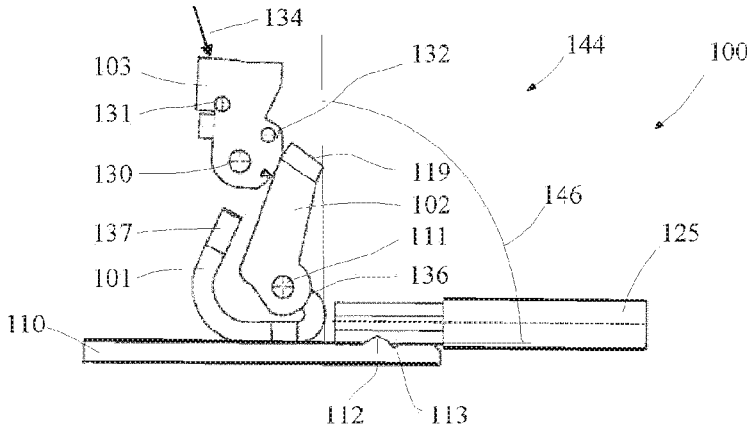
FIG. 7 is a highly schematic side view of the electrical connection terminal according to FIG. 1 in a first position.

FIG. 7 shows the electrical connection terminal 100 for example in the open state 144. A leg 136 of the clamping spring 101 engages behind the pivot pin 111 of the clamping lever 102 while the other leg 137 is free. The actuation lever 103 is far above the clamping spring 101. The first pin 130 and the second pin 131 are in the closure slot 104 (not shown here) of the slotted guide 114. In this position, a conductor can be pivoted from above into the wide-open connection terminal.

Here, the opening angle 146 between the current bar 110 and the clamping edge 119 of the clamping lever 102 is considerably more than 75° and in this case even 90°. Depending on the geometric design of the clamping lever 102, the opening angle 146 can also be selected to be even larger or somewhat smaller. Generally, however, an opening angle 146 of 75° is sufficient to be able to pivot even particularly rigid conductors 126 of large cross sections into the pivot region 115 from above. Any conductor can be pivoted in at an opening angle of 90°.

Figure 8:
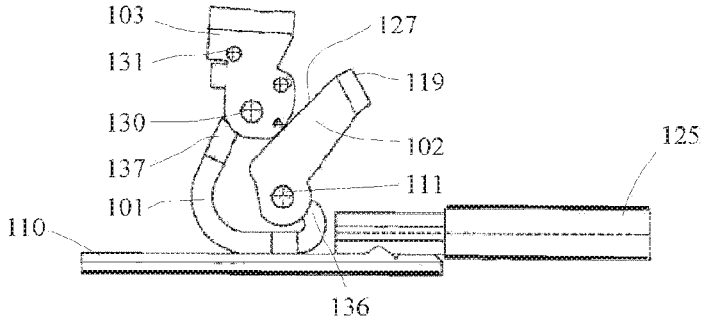
FIG. 8 is a highly schematic side view of the electrical connection terminal according to FIG. 1 in a second position.

By means of a substantially downward movement of the actuation lever 103 along the arrow 134, the connection terminal is transferred from the open state according to FIG. 7 into the state according to FIG. 8. In this case, the clamping lever 102, which is open by approximately 90°, is pivoted by almost 45° since the clamping lever 102 of the eccentric curve 129 comes into contact with the sliding edge 127 of the clamping lever 102 and thus ensures wide pivoting of the clamping lever 102.

In the view according to FIG. 8, the first pin 130 begins to enter the cross section, spanned by the legs 136 and 137, of the clamping spring 101.

When the first pin 130 and the second pin 131 move further downwards along the closure slot 104 of the slotted guide 114, the contact of the eccentric curve 129 with the clamping curve 128 of the clamping lever 102 largely closes the clamping lever 102. For example in this state, the first pin 130 reaches the bottom of the closure slot 104 and the second pin 131 reaches the branch of the release slot 106.

Figure 9:
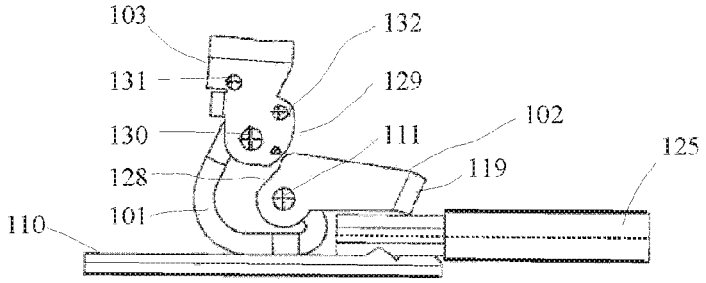
FIG. 9 is a highly schematic side view of the electrical connection terminal according to FIG. 1 in a third position.

Next, the actuation lever 103 is pivoted, the first pin 130 entering the clamping slot 105 and the second pin 131 entering the release slot 106. In the process, the first pin 130 presses against the leg 137 of the clamping spring 101 and clamps the clamping spring 101, while at the same time the eccentric curve 129 is in contact with the clamping curve 128 of the clamping lever 102 and ensures further pivoting of the clamping lever 102 so that the clamping edge 119 is pressed against the conductors 126 of the cable 125, as shown in FIG. 9.

Figure 10:
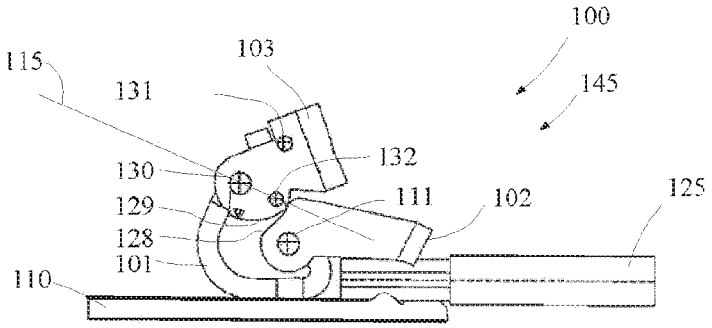
FIG. 10 is a highly schematic side view of the electrical connection terminal according to FIG. 1 in a fourth position.

FIG. 10 shows the clamped state 145, in which the clamping spring 101 is clamped and ensures that the clamping state 145 is maintained. In this case, the actuation lever 103 and the clamping lever 102 are oriented such that self-locking is achieved, and so the set state is maintained after the tool 120 is removed from the tool opening 109 until the electrical connection terminal 100 is reopened by reinserting the tool 120 and by movement in the opposite direction.

The invention allows for a connection terminal 100 having a large opening angle while the electrical connection terminal 100 can simultaneously be closed again with a low actuation force. Since the actuation lever 103 can first be lowered with practically no force, the pivot path is available for generating a high clamping force.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

| List of reference numerals | |
|---|---|
| connection terminal | 100 |
| clamping spring | 101 |
| clamping lever | 102 |
| actuation lever, eccentric | 103 |
| closure slot, slot arm | 104 |
| clamping slot, slot arm | 105 |
| release slot, slot arm | 106 |
| hole | 107 |
| mount | 108 |
| tool opening | 109 |
| current bar | 110 |
| pivot pin | 111 |
| guide | 112 |
| groove | 113 |
| slot | 114 |
| straight line | 115 |
| wall | 116 |
| wall | 117 |
| narrowing | 118 |
| clamping edge | 119 |
| tool, screwdriver | 120 |
| lug | 122 |
| lug | 123 |
| cable | 125 |
| conductor | 126 |
| sliding edge | 127 |
| clamping curve | 128 |
| eccentric curve | 129 |
| first pin | 130 |
| second pin | 131 |
| pin | 132 |
| pin | 133 |
| arrow | 134 |
| return spring | 135 |
| leg | 136 |
| leg | 137 |
| branching point | 138 |
| diameter | 140 |
| diameter | 141 |
| width | 142 |
| open state | 144 |
| clamped state | 145 |
| opening angle | 146 |

The invention claimed is:

1. A connection terminal for connecting, in an electrically contacting manner, at least one conductor to a current bar held on a mount, the connection terminal comprising:

an actuation lever;

a clamping spring; and a slotted guide, the slotted guide comprising at least one closure slot and a clamping slot that branches off transversely therefrom, wherein the actuation lever is configured to he movably guided in the slotted guide by a first pin and a second pin.

2. The connection terminal according to claim 1, wherein the at least one closure slot extends substantially transversely to the current bar.

3. The connection terminal according to claim 1, wherein the slotted guide further comprises a release slot that branches transversely from the closure slot, wherein the release slot and the clamping slot extend in opposite directions.

4. The connection terminal according to claim 3, wherein the release slot, the clamping slot, and at least a part of the closure slot that interconnects the release slot and the clamping slot are "S"-shaped.

5. The connection terminal according to claim 1, wherein the first pin has a larger diameter than a width of the release slot and wherein the second pin has a smaller diameter than the width of the release slot.

6. The connection terminal according to claim 1, wherein, in a clamped state of the connection terminal, the first pin is disposed in the clamping slot and the second pin is disposed in the release slot.

7. The connection according to claim 1, further comprising a clamping lever pivotally held on the mount by a pivot pin, wherein the actuation lever is configured to act on the clamping lever.

8. The connection according to claim 7, wherein the clamping spring is configured to act on the first pin and on the pivot pin when the connection terminal is in a clamped state.

9. The connection terminal according to claim 7, wherein the clamping lever is disposed behind a dead centre when the connection terminal is in a clamped state.

10. The connection terminal according to claim 1, wherein the first pin is configured to rest against the clamping spring when the connection terminal is in a clamped state and is configured to be at a distance from the clamping spring when the connection terminal is in an open state.

11. The connection terminal according to claim 1, wherein the actuation lever comprises a tool opening.

12. The connection terminal according to claim 1, wherein at least one of bent lugs are provided on the actuation lever or a pin is held to provide a counterbearing during actuation of the connection terminal.

13. The connection terminal according to claim 1, further comprising a return spring configured. to preload the actuation lever into an open state, and wherein the return spring is configured to increase a clamping force when in a clamped state.

14. The connection terminal according to claim 1, wherein the mount, the clamping lever, and the actuation lever comprise punched bent parts.

15. The connection terminal according to claim 1, wherein the current bar comprises at least one groove configured to secure the at least one conductor and comprises at least one conductor guide configured to centre the at least one conductor.

16. A method for connecting a conductor to a connection terminal to contact the conductor in an electrically conductive manner, a current bar held on a mount of the connection terminal the method comprising:

providing an actuation lever configured for actuation; and providing a damping spring configured to generate a clamping force, wherein the actuation lever is configured to be movably guided in a slotted guide of the connection terminal by a first pin and a second pin, wherein, for the connection, the actuation lever is first guided in a closure slot of the slotted guide of the connection terminal by the first pin and by the second pin, and wherein, upon reaching a clamping slot that branches off transversely from the closure slot of the connection terminal, the first pin is guided into the clamping slot.

17. The method according to claim 16, wherein the actuation lever is first guided in a longitudinal direction and then pivoted.

18. The method according to claim 17, wherein, during pivoting, the second pin enters a release slot that branches off transversely from the closure slot.

* * * * *